US010974302B2

(12) United States Patent
Yamakita

(10) Patent No.: US 10,974,302 B2
(45) Date of Patent: Apr. 13, 2021

(54) MANUFACTURING METHOD FOR CYLINDRICAL PORTION

(71) Applicant: TOYOTA BOSHOKU KABUSHIKI KAISHA, Aichi (JP)

(72) Inventor: Yuta Yamakita, Aichi (JP)

(73) Assignee: TOYOTA BOSHOKU KABUSHIKI KAISHA, Aichi (JP)

( * ) Notice: Subject to any disclaimer, the term of this patent is extended or adjusted under 35 U.S.C. 154(b) by 195 days.

(21) Appl. No.: 15/989,957

(22) Filed: May 25, 2018

(65) Prior Publication Data

US 2018/0339330 A1 Nov. 29, 2018

(30) Foreign Application Priority Data

May 26, 2017 (JP) ..... JP2017-104498

(51) Int. Cl.
*B21D 24/00* (2006.01)
*B21D 22/20* (2006.01)
(Continued)

(52) U.S. Cl.
CPC ..... *B21D 24/005* (2013.01); *B21D 22/20* (2013.01); *B21D 22/28* (2013.01); *B21D 22/30* (2013.01);
(Continued)

(58) Field of Classification Search
CPC ..... B21D 22/06; B21D 24/04; B21D 24/005; B21D 24/10; B21D 28/243; B21D 28/34;
(Continued)

(56) References Cited

U.S. PATENT DOCUMENTS 7,415,859 B2 * 8/2008 Ser ..... B21D 22/02 72/355.6
2006/0236519 A1 10/2006 Ser et al.
2011/0016944 A1 * 1/2011 Tamai ..... B21D 22/02 72/358

FOREIGN PATENT DOCUMENTS

CN 101259509 9/2008
CN 203091528 7/2013
(Continued)

OTHER PUBLICATIONS

Chinese Office Action in counterpart Chinese Application No. 201810516153.X, dated Jul. 31, 2019 (along with English-language translation).

(Continued)

*Primary Examiner* — Teresa M Ekiert
(74) *Attorney, Agent, or Firm* — Greenblum & Bernstein, P.L.C.

(57) ABSTRACT

Provided is a manufacturing method for a cylindrical portion in a cylindrical shape protruding in a plate thickness direction of a plate-like portion made of metal, the cylindrical portion being formed integrally with the plate-like portion. The manufacturing method uses a manufacturing device including: a first metal mold provided with an inner circumferential surface that comes in contact with an outer circumferential surface of the cylindrical portion; a second metal mold coming in contact with a protruding tip of the cylindrical portion; and a third metal mold coming into press contact with a workpiece toward a side of the second metal mold. The third metal mold is displaced toward the side of the second metal mold and a portion of the workpiece undergoes plastic flow toward the inner circumferential surface, whereby the portion that underwent the plastic flow comes into press contact with the inner circumferential surface.

6 Claims, 5 Drawing Sheets

(51) Int. Cl.

| | |
|---|---|
| ***B21D 35/00*** | (2006.01) |
| ***B21D 22/30*** | (2006.01) |
| ***B21D 22/28*** | (2006.01) |
| ***B21K 1/40*** | (2006.01) |
| ***B21D 37/10*** | (2006.01) |
| ***B21K 1/30*** | (2006.01) |
| ***B21D 53/16*** | (2006.01) |

(52) U.S. Cl.
CPC ..... *B21D 24/00* (2013.01); *B21D 35/00* (2013.01); *B21D 37/10* (2013.01); *B21D 53/16* (2013.01); *B21K 1/40* (2013.01); *B21K 1/30* (2013.01)

(58) Field of Classification Search
CPC ..... B21D 28/30; B21D 37/08; B21D 37/10; B21D 22/20; B21D 22/30; B21D 22/28; B21D 24/00; B21D 35/00; B21K 1/30
See application file for complete search history.

(56) References Cited

FOREIGN PATENT DOCUMENTS

| | | |
|---|---|---|
| EP | 0937523 | 8/1999 |
| JP | 62-176629 | 8/1987 |
| JP | 11-236957 | 8/1999 |
| JP | 2015-020205 | 2/2015 |

OTHER PUBLICATIONS

Japanese Notice of Reasons for Refusal issued in Japan patent application No. 2017-104498, dated Nov. 17, 2020 and its machine-generated English translation.

* cited by examiner

MANUFACTURING METHOD FOR CYLINDRICAL PORTION

CROSS-REFERENCE TO RELATED APPLICATIONS

This application claims the benefit of Japanese Patent Application No. 2017-104498 filed on May 26, 2017 with the Japan Patent Office, the entire disclosure of which is incorporated herein by reference.

BACKGROUND

The present disclosure relates to a manufacturing method for forming a cylindrical portion integrally with a plate-like portion.

For example, as described in Japanese Unexamined Patent Application Publication No. 2015-20205 a processed product made from a metal plate is mostly manufactured by a press-forming method that excels in terms of mass production capability (productivity).

SUMMARY

In case that high accuracy with respect to an outer circumferential diameter of the cylindrical portion and cylindricality (see JIS B 0021) thereof are required, machining such as cutting and the like is commonly conducted to the cylindrical portion. However, the machining is generally inferior to the press-forming method in terms of the mass production capability (productivity). Thus, the present disclosure provides one example of a manufacturing method applicable to a case where the high accuracy with respect to the outer circumferential diameter of a cylindrical portion and the cylindricality thereof are required.

One aspect of the present disclosure is a manufacturing method for a cylindrical portion in a cylindrical shape protruding in a plate thickness direction of a plate-like portion made of metal, the cylindrical portion being formed integrally with the plate-like portion. The manufacturing method comprises a plastic forming step using a manufacturing device comprising: a first metal mold provided with an inner circumferential surface that comes in contact with an outer circumferential surface of the cylindrical portion to be formed; a second metal mold coming in contact with a protruding tip of the cylindrical portion to be formed; and a third metal mold disposed on an opposite side of the second metal mold with a workpiece therebetween, the third metal mold coming into press contact with the workpiece toward a side of the second metal mold. In the plastic forming step, the third metal mold is displaced toward the side of the second metal mold and a portion of the workpiece undergoes plastic flow toward the inner circumferential surface, whereby the portion that underwent the plastic flow comes into press contact with the inner circumferential surface.

In such a manner, a metal structure that underwent the plastic flow toward the inner circumferential surface is formed to be the cylindrical portion to which a shape of the inner circumferential surface is transferred. Accordingly, an outer circumferential diameter of the cylindrical portion and cylindricality thereof become identical to a dimension of the first metal mold. As a result, high accuracy in the outer circumferential diameter of the cylindrical portion and in the cylindricality thereof can be achieved.

The manufacturing method may be the following method.

When the plastic forming step is a second plastic forming step, it is desirable that the manufacturing method comprise a first plastic forming step that is performed before the second plastic forming step is performed. In the first plastic forming step, it is desirable that a portion of the plate-like portion come into press contact so as to undergo plastic flow, thereby forming a protruding portion that protrudes toward the side of the second metal mold. In the second plastic forming step, it is desirable that a portion of the protruding portion undergo plastic flow toward a side of the inner circumferential surface.

In such a manner, since the metal structure constituting the protruding portion undergoes the plastic flow in the first plastic forming step and then the cylindrical portion is formed, the second plastic forming step is certainly performed. In other words, the first plastic forming step is performed, whereby, for example, problems such as a shortage of the metal structure that must undergo the plastic flow in the second plastic forming step, and the like, can be inhibited from occurring.

"Protrudes toward the side of the second metal mold" appeared above is referred to as "protrudes toward a side at which the second metal mold is disposed". For example, the "protruding toward the side of the second metal mold" in a case that will be described in the following embodiments corresponds to "protrudes downward".

It is desirable that a third plastic forming step where a tooth profile is formed on an outer side in a radial direction of the cylindrical portion in the plate-like portion be performed after the second plastic forming step is completed.

The present disclosure further provides one example of a manufacturing device applicable to a case where the high accuracy with respect to the outer circumferential diameter of a cylindrical portion and the cylindricality thereof are required. One aspect of the present disclosure is a manufacturing device of a cylindrical portion in a cylindrical shape protruding in a plate thickness direction of a plate-like portion made of metal, the cylindrical portion being formed integrally with the plate-like portion. The manufacturing device comprises: a first metal mold provided with an inner circumferential surface that comes in contact with an outer circumferential surface of the cylindrical portion to be formed; a second metal mold disposed at a protruding tip of the cylindrical portion to be formed; a projecting portion disposed in the second metal mold, the projecting portion projecting toward a side of a workpiece; and a third metal mold disposed on an opposite side of the second metal mold with the workpiece therebetween, the third metal mold coming into press contact with the workpiece toward a side of the second metal mold. In the manufacturing device, the third metal mold is displaced toward the side of the second metal mold and a portion of the workpiece undergoes plastic flow toward the inner circumferential surface, whereby the portion that underwent the plastic flow comes into press contact with the inner circumferential surface.

BRIEF DESCRIPTION OF THE DRAWINGS

Hereinafter, an embodiment of the present disclosure will be described below with reference to the accompanying drawings, in which.

DETAILED DESCRIPTION OF THE PREFERRED EMBODIMENTS

Figure 1:
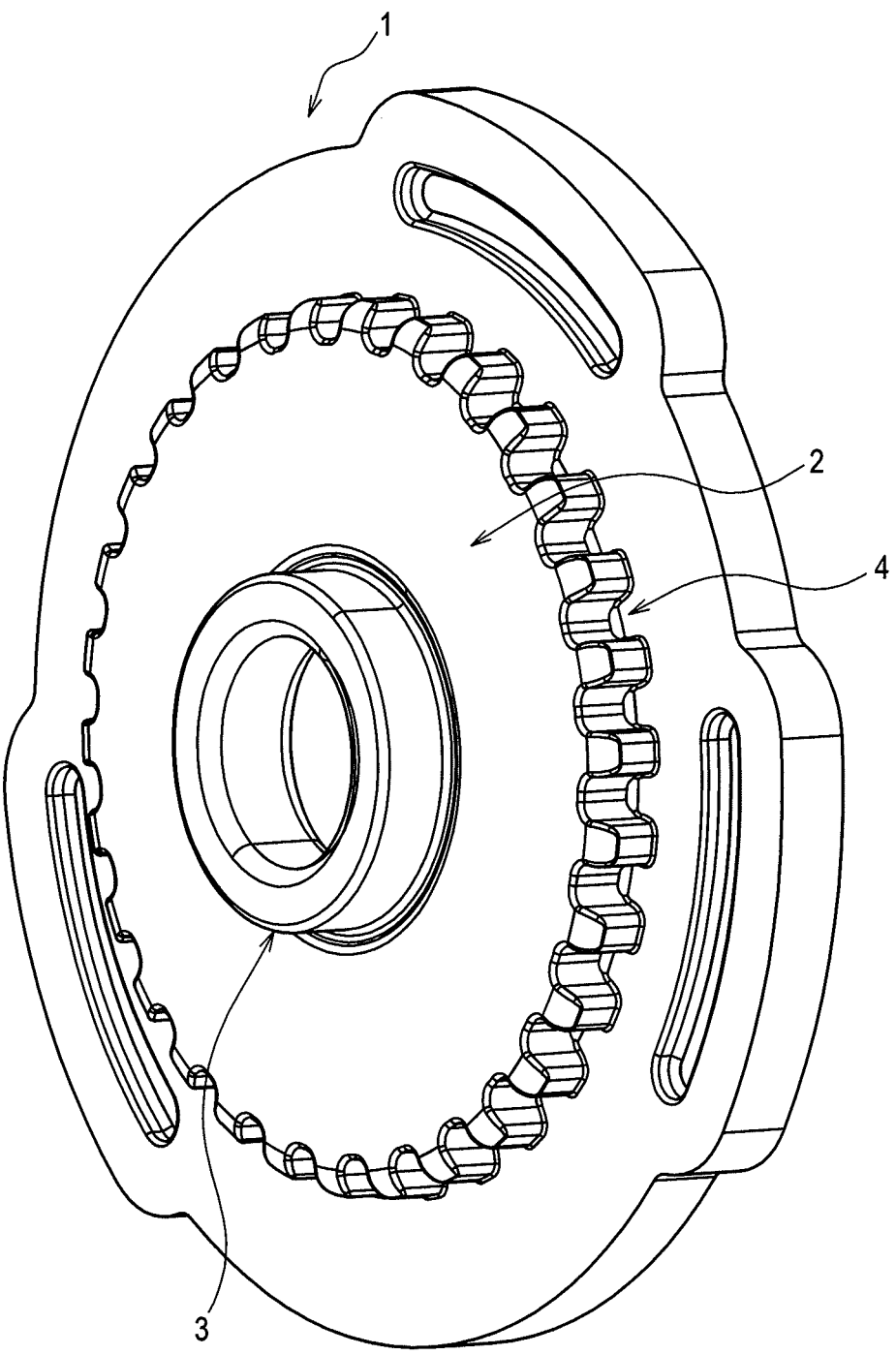
FIG. 1 is a perspective view of a workpiece according to the embodiment.

"Embodiments" to be described below are example embodiments within the technical scope of the present disclosure. In other words, invention-specifying-matters and so on recited in the accompanying claims are not limited to specific configurations, structures, and the like, shown in the below-described embodiments.

Arrows and marks that indicate directions shown in the drawings are provided for easy understanding of mutual relationships between the drawings. The present disclosure is not limited by the directions shown in the drawings.

1. Outline

A manufacturing method for an external tooth plate 1 shown in FIG. 1 will be described in the present embodiment. The external tooth plate 1 may be a component of an electrical recliner. The electrical recliner is a mechanism applied to a seat (not shown) such as a vehicle seat for pivoting a seatback (not shown) of the seat with respect to a seat cushion (not shown).

The external tooth plate 1 (hereinafter referred to as a workpiece 1) comprises: a plate-like portion 2; a cylindrical portion 3; and a tooth portion 4. The external tooth plate 1 is preferably a member made of metal. The cylindrical portion 3 is a cylindrical portion protruding in a plate thickness direction of the plate-like portion 2.

The tooth portion 4 constitutes an external tooth gear formed on an outer side in a radial direction of the cylindrical portion 3 in the plate-like portion 2. The plate-like portion 2, the cylindrical portion 3, and the tooth portion 4 are, as described later, preferably made of metal and integrally formed by plastic forming.

2. Manufacturing Method for Workpiece

In FIG. 2 to FIG. 5, operations of a manufacturing device used in the manufacturing method according to the present embodiment are shown in sequence of operation steps. The manufacturing device performs the following forming steps sequentially to the workpiece 1 so that the external tooth plate 1 is formed from a metal plate material. Hereinafter, the aforementioned forming steps are referred to as "a first plastic forming step", "a second plastic forming step", "a punching step", and "a third plastic forming step" in sequence of the operation steps.

The manufacturing device comprises a first stage to a third stage. In the first stage, first plastic forming of the first plastic forming step is performed. In the second stage, second plastic forming of the second plastic forming step and punching of the punching step are performed. In the third stage, third plastic forming of the third plastic forming step is performed.

In the manufacturing device, the workpiece 1 is transferred from the first stage to the second stage and to the third stage in sequence, and therein, the first plastic forming through the third plastic forming are performed to the workpiece 1 sequentially.

<First Plastic Forming Step>

Figure 2:
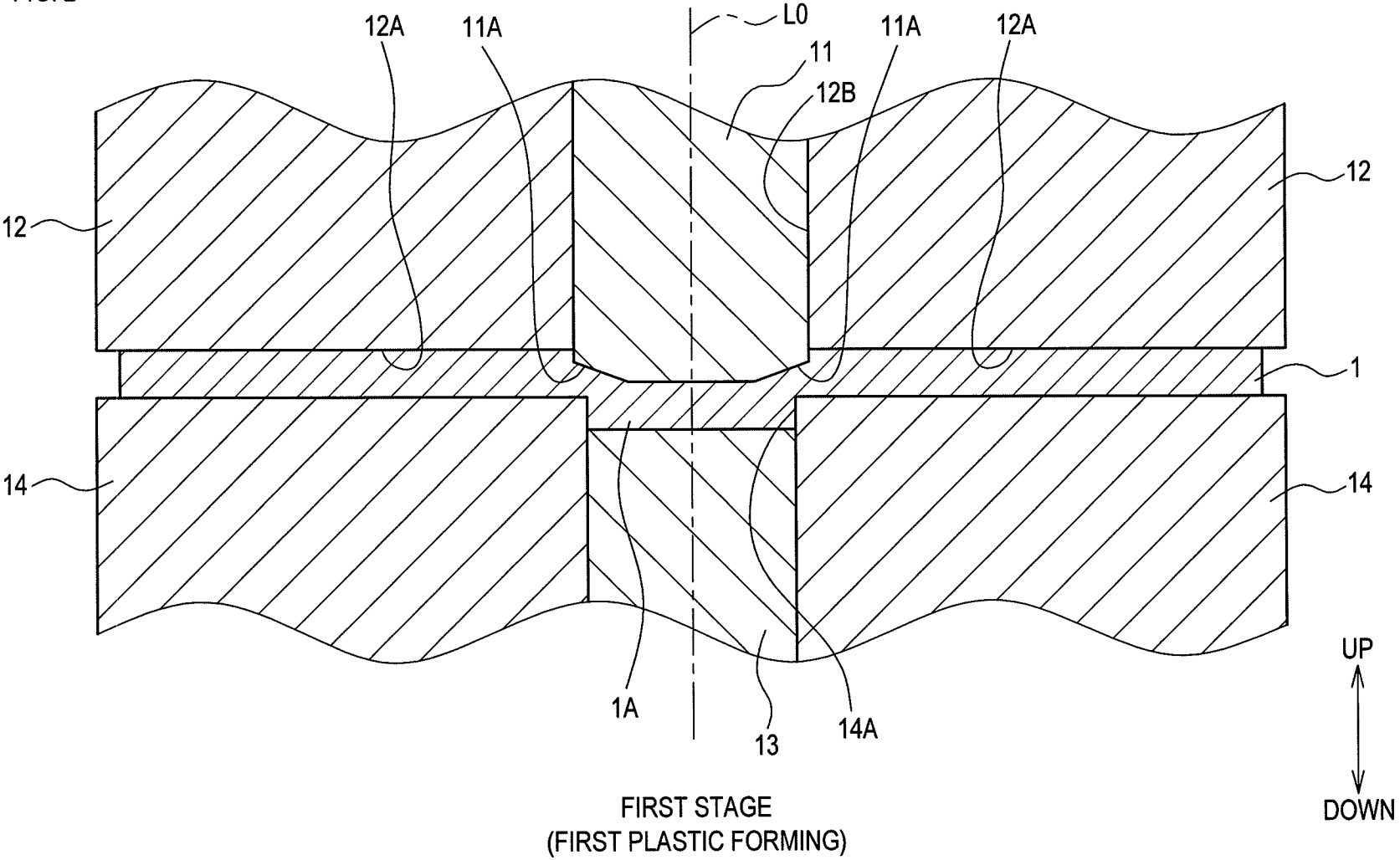
FIG. 2 is a drawing showing a first plastic forming step according to the embodiment.

In FIG. 2, the first stage (of the manufacturing device) where the first plastic forming is performed comprises a first movable punch 11, a first immovable punch 12, a first die 13, and a second die 14 as shown in FIG. 2. The first immovable punch 12, the first die 13, and the second die 14 may be immovable metal molds.

A top surface of the first die 13 is lower than a top surface of the second die 14. Thus, at the first die 13, a first hollow 14A in a cylindrical concave shape with respect to the second die 14 is formed.

The first movable punch 11 is a substantially cylindrical metal mold that is displaceable (vertically along a central axis line L0) with respect to the first immovable punch 12, the first die 13, and the second die 14. Specifically, the first immovable punch 12 is provided with a through-hole 12B where the first movable punch 11 is stored in a displaceable manner.

The first movable punch 11 stored in the through-hole 12B is displaceable in vertical directions so as to come close to and go apart from the first die 13 and the second die 14. An end of an outer circumferential portion of the first movable punch 11 comprises a first taper portion 11A.

The first taper portion 11A is a sloping surface in a substantially truncated conical shape sloping with respect to a contact surface 12A between the first immovable punch 12 and the workpiece 1. In other words, the first taper portion 11A is substantially a truncated cone so as to slope and come closer to the first die 13 as the truncated cone approaches the central axis line L0 of the first movable punch 11.

When moving toward the first die 13 (vertically downward in FIG. 2), the first movable punch 11 comes into press contact with an upper surface of a target portion of the metal plate material constituting the workpiece 1. This presses the target portion downwards such that a lower surface of the target portion comes into press contact with an upper surface of the first die 13. The target portion undergoes plastic flow so that a protruding portion 1A protrudes downward from the (and is formed integrally with) the plate-like portion 2 (see FIG. 1).

Specifically, in the first plastic forming step, the target portion of the workpiece 1 undergoes plastic flow and flows into the first hollow 14A so that the protruding portion 1A having a substantially cylindrical shape is formed. When the first plastic forming is completed, the workpiece 1 is transferred to the second stage.

<Second Plastic Forming Step>

Figure 3:
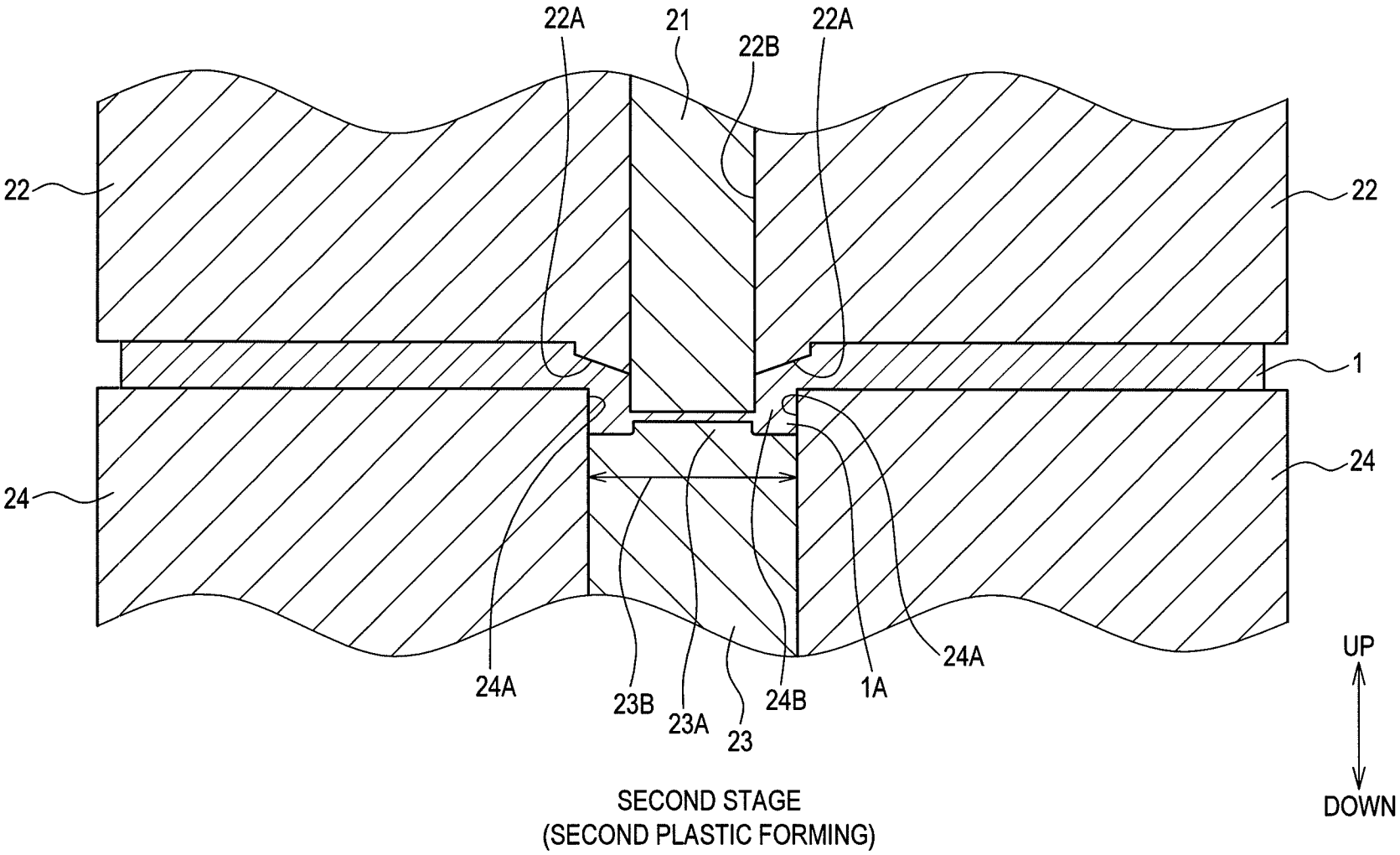
FIG. 3 is a drawing showing a second plastic forming step according to the embodiment.

In FIG. 3, the second stage (of the manufacturing device) where the second plastic forming is performed comprises a second movable punch 21, a second immovable punch 22, a third die 23, a fourth die 24, and so forth. The second immovable punch 22 and the fourth die 24 may be immovable metal molds.

The second movable punch 21 is disposed to be opposed to the third die 23 with the workpiece 1 therebetween. The second movable punch 21 is a substantially cylindrical metal mold that comes into press contact with a second target portion of the workpiece 1, and presses the second target portion downward toward an upper surface of the third die 23. The second immovable punch 22 is provided with a through-hole 22B where the second movable punch 21 is stored in a displaceable manner.

The second movable punch 21 stored in the through-hole 22B is displaceable in vertical directions so as to come close to and go apart from the third die 23 and the fourth die 24. A diameter of the second movable punch 21 is smaller than a diameter of the first movable punch 11 disposed in the first stage.

In other words, the diameter of the second movable punch 21 is smaller than an outer diameter of the protruding portion 1A. The diameter of the second movable punch 21 is substantially identical to an inner circumferential diameter of the cylindrical portion 3 (see FIG. 1).

The third die 23 is a cylindrical metal mold that comes in contact with a protruding tip of the protruding portion 1A which will be the cylindrical portion 3 after the forming. A diameter of the third die 23 is substantially identical to an outer diameter of the cylindrical portion 3 and larger than a diameter of the second movable punch 21.

In the third die 23, provided at a center of a portion (hereinafter, referred to as a first contact portion 23B) that comes in contact with the protruding tip of the protruding portion 1A is a projecting portion 23A that has a cylindrical shape and projects toward a side of the second movable punch 21. In other words, the projecting portion 23A is disposed in a portion that is opposed to the second movable punch 21 within the first contact portion 23B.

A diameter of the projecting portion 23A is smaller than the diameter of the third die 23. Accordingly, assuming that images of the projecting portion 23A and the second movable punch 21 are projected on a virtual flat surface orthogonal to a direction in which the second movable punch 21 comes into press contact (a vertical direction in FIG. 3), the image of the projecting portion 23A is placed inside the image of the second movable punch 21.

In the second immovable punch 22, a taper portion 22A is provided around an outer circumferential side of the second movable punch 21. The taper portion 22A, disposed at a position corresponding to that of the first taper portion 11A disposed in the first stage, is a sloping surface in a substantially truncated conical shape sloping in the same direction as the first taper portion 11A.

A top surface of the third die 23 is disposed to be lower than a top surface of the fourth die 24. Thus, at the third first die 23, a second hollow 24B in a cylindrical concave shape with respect to the fourth die 24 is formed. And the protruding portion 1A of the workpiece 1 transferred from the first stage fits into the second hollow 24B.

Specifically, in the second stage, the protruding portion 1A fits into the second hollow 24B so as to protrude on the side of the third die 23. An inner circumferential surface 24A of the fourth die 24 comes in contact with the outer circumferential surface of the cylindrical portion 3 after the forming (in other words, the outer circumferential surface of the protruding portion 1A).

Then, in the second plastic forming step, the second movable punch 21 is displaced toward the side of the third die 23 and a portion of the workpiece 1 undergoes plastic flow toward the inner circumferential surface 24A so that the portion that underwent the plastic flow comes into press contact with the inner circumferential surface 24A.

That is, when the second movable punch 21 is displaced toward the side of the third die 23, the protruding portion 1A partially undergoes the plastic flow toward a side of the inner circumferential surface 24A, in other words, toward an outer side in a radial direction of the protruding portion 1A. Since a metal structure that underwent the plastic flow is pressed against the inner circumferential surface 24A, a shape of the inner circumferential surface 24A is transferred to the outer circumferential surface of the protruding portion 1A as shown in FIG. 3.

Then, the second movable punch 21 comes close to the third die 23 and when a distance between the second movable punch 21 and the third die 23 becomes equal to or less than a predetermined distance or when the second movable punch 21 comes in contact with the third die 23, the third die 23 starts receding from the protruding tip of the protruding portion 1A.

<Punching Step>

Figure 4:
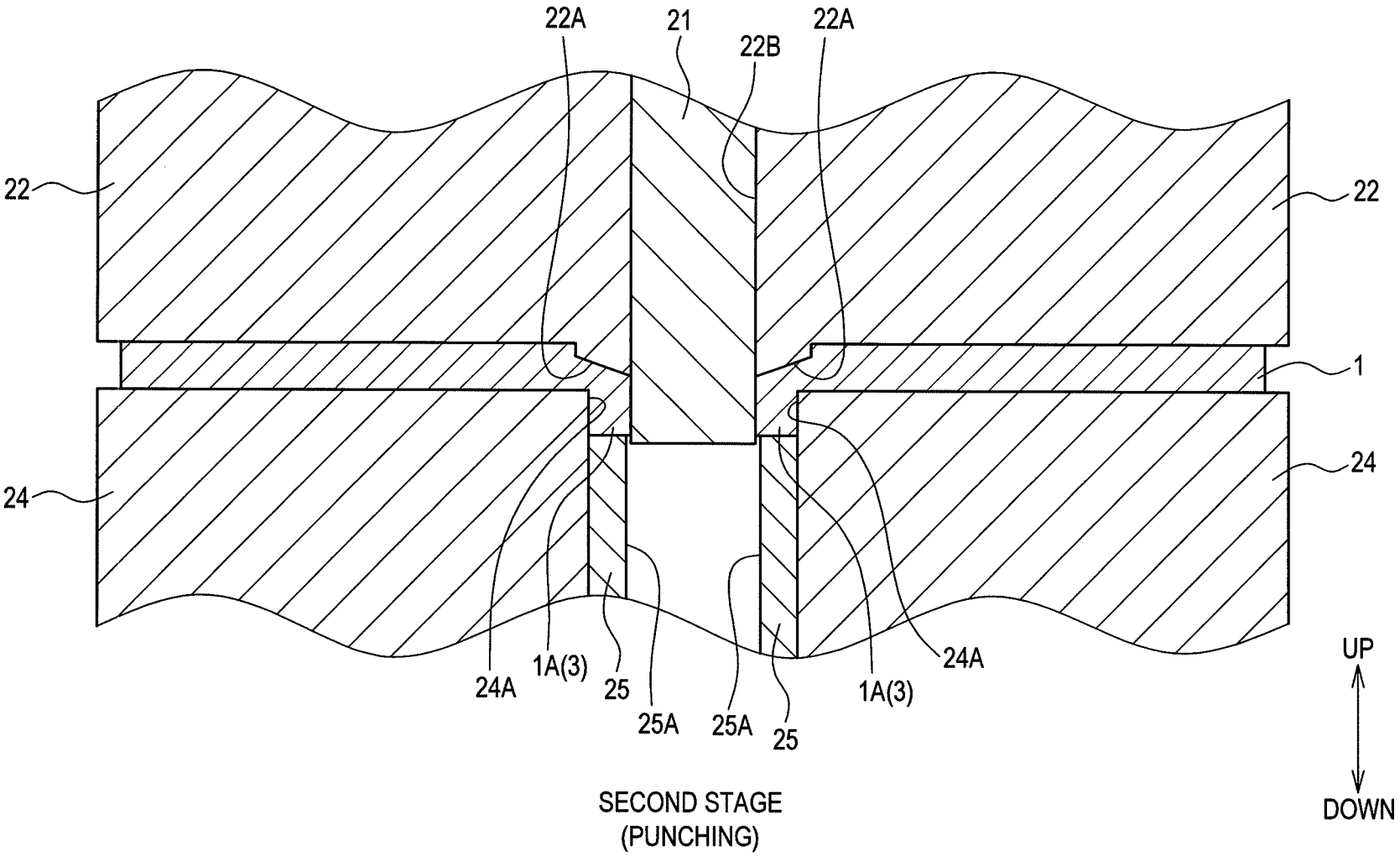
FIG. 4 is a drawing showing a punching step according to the embodiment.

In the punching, as shown in FIG. 4, the second movable punch 21 penetrates the protruding portion 1A, whereby a through-hole is provided in the protruding portion 1A and the protruding portion 1A in the cylindrical shape is formed to be the cylindrical portion 3 in a tubular shape.

In the punching step, instead of the third die 23, a fifth die 25 in a tubular shape is used. The fifth die 25 is a tubular metal mold and comprises a hollow 25A into which the second movable punch 21 can fit.

An outer diameter of the fifth die 25 is substantially identical to (or slightly larger than, as shown in FIG. 4) a diameter of the inner circumferential surface 24A. An inner diameter of the fifth die 25 is substantially identical to the diameter of the second movable punch 21, in other words, the inner diameter of the cylindrical portion 3.

<Third Plastic Forming Step>

Figure 5:
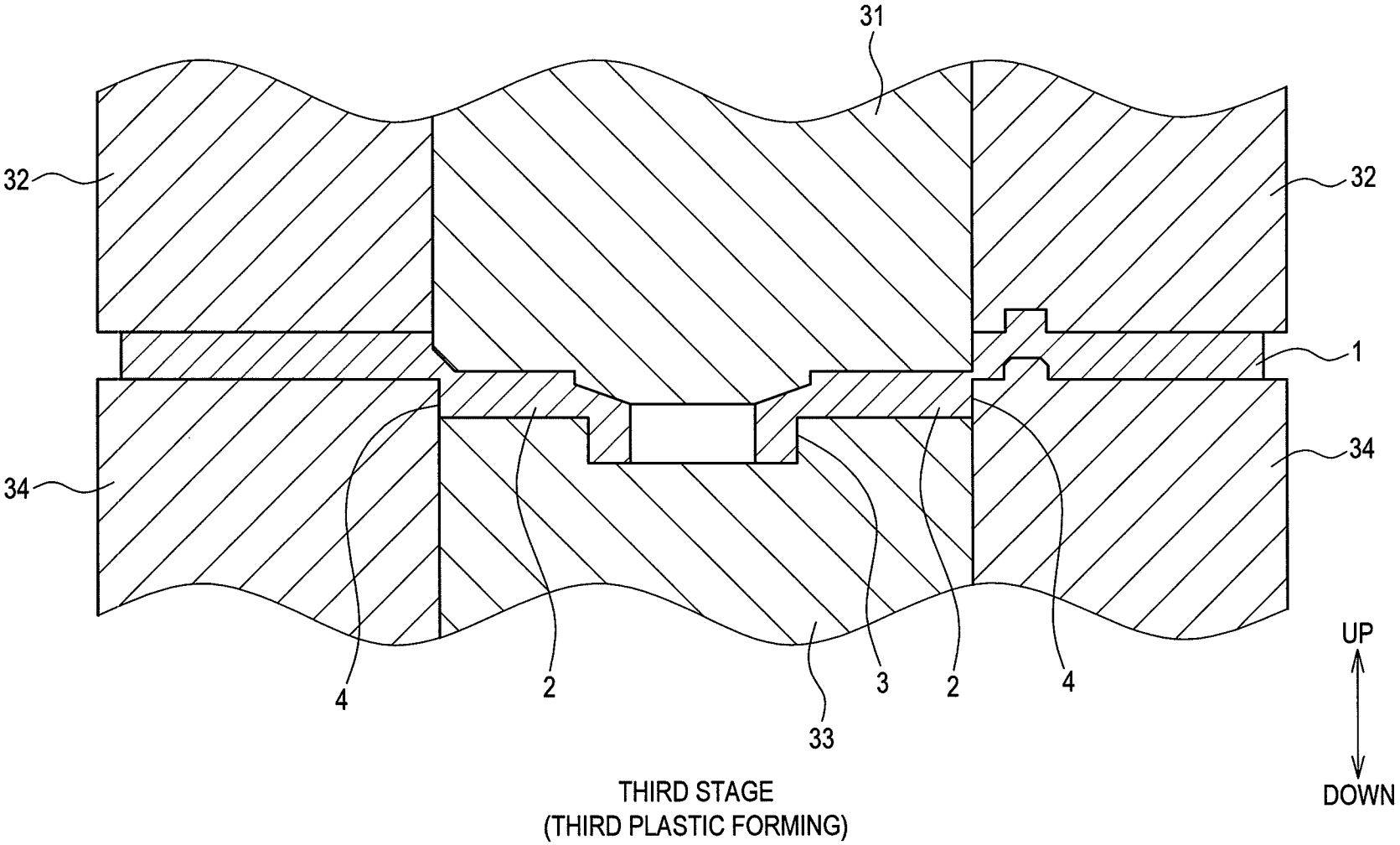
FIG. 5 is a drawing showing a third plastic forming step according to the embodiment.

The third plastic forming is for forming a tooth profile that constitutes the tooth portion 4 on the outer side in the radial direction of the cylindrical portion 3 in the plate-like portion 2 as shown in FIG. 5.

The third stage (of the manufacturing device) where the third plastic forming is performed comprises a third movable punch 31, a third immovable punch 32, a sixth die 33, a seventh die 34, and so forth as shown in FIG. 5. The sixth die 33 and the seventh die 34 are immovable metal molds.

Through displacement toward sides of the sixth die 33 and the seventh die 34, the third movable punch 31 and the third immovable punch 32 come into press contact with the workpiece 1 so that the workpiece 1 partially undergoes plastic flow and the tooth portion 4 is formed. Further, in the third plastic forming, other portions than the tooth portion 4 may also be processed.

3. Features of Manufacturing Method According to Present Embodiment

In the second plastic forming, the metal structure that underwent the plastic flow toward the inner circumferential surface 24A is formed to be the cylindrical portion 3 to which the shape of the inner circumferential surface 24A is transferred. Accordingly, an outer circumferential diameter of the cylindrical portion 3 and cylindricality thereof become identical to the diameter and cylindricality of the inner circumferential surface 24A formed on the fourth die 24. As a result, high accuracy in the outer circumferential diameter of the cylindrical portion 3 and in the cylindricality thereof can be achieved.

Dimensional accuracy of a metal mold is higher than that of a product formed by the metal mold. In the present embodiment, the metal structure that underwent the plastic flow toward the inner circumferential surface 24A is formed to be the cylindrical portion 3 to which the inner circumferential surface 24A is transferred. This can achieve the high accuracy in the outer circumferential diameter of the cylindrical portion 3 and in the cylindricality thereof.

In the manufacturing device, the protruding portion 1A is formed in the first plastic forming, and in the second plastic forming, the metal structure of the protruding portion 1A undergoes the plastic flow toward the side of the inner circumferential surface 24A, which allowing the metal structure constituting the protruding portion 1A to undergo the plastic flow so that the cylindrical portion 3 is formed.

In such a manner, the second plastic forming step 2 can be certainly performed. In other words, the first plastic forming step is performed before the second plastic forming step, whereby, for example, problems such as a shortage of the metal structure that must undergo the plastic flow in the second plastic forming, and the like, can be inhibited from occurring.

After the second plastic forming step is completed, the tooth profile constituting the tooth portion 4 is formed. This can enhance accuracy of a relative dimension of the tooth portion 4 with respect to the cylindrical portion 3. Specifically, since the tooth portion 4 is formed with the cylindrical portion 3 used as a criteria, the accuracy in the relative dimension of the tooth portion 4 with respect to the cylindrical portion 3 can be enhanced.

In the third die 23, the projecting portion 23A is disposed (see FIG. 3). This makes it possible that the metal structure of the protruding portion 1A can certainly undergo the plastic flow toward the side of the inner circumferential surface 24A. In other words, the projecting portion 23A can serve as a guide member to lead the metal structure to undergo the plastic flow toward the side of the inner circumferential surface 24A.

The aspect of the present disclosure is the manufacturing method for the cylindrical portion (3) in a cylindrical shape protruding in the plate thickness direction of the plate-like portion (2) made of metal, the cylindrical portion (3) being formed integrally with the plate-like portion (2). The manufacturing method comprises a plastic forming step using a manufacturing device comprising: a first metal mold (24) provided with the inner circumferential surface (24A) that comes in contact with the outer circumferential surface of the cylindrical portion (3) to be formed; a second metal mold (23) coming in contact with the protruding tip of the cylindrical portion (3) to be formed; and a third metal mold (21) disposed on an opposite side of the second metal mold (23) with the workpiece (1) therebetween, the third metal mold (21) coming into press contact with the workpiece (1) toward the side of the second metal mold (23). In the plastic forming step, the third metal mold (21) is displaced toward the side of the second metal mold (23) and a portion of the workpiece (1) undergoes plastic flow toward the inner circumferential surface (24A), whereby the portion that underwent the plastic flow comes into press contact with the inner circumferential surface (24A).

Other Embodiments

In the above-described embodiment, the first plastic forming for forming the protruding portion 1A is performed before the second plastic forming is performed. However, the present disclosure is not limited to this. For example, the first plastic forming may be omitted.

The above-described embodiment described an example of forming the external tooth plate 1. However, the present disclosure is not limited to this. For example, the present disclosure is applicable to forming a portion other than the external tooth plate (for example, a portion not comprising the tooth portion 4) as far as such a portion comprises the cylindrical portion 3.

In the above-described embodiment, the projecting portion 23A is disposed in the third die 23. However, the present disclosure is not limited to this. For example, the projecting portion 23A may not be disposed in the third die 23.

The projecting portion 23A according to the above-described embodiment is a cylindrically projecting portion. However, the present disclosure is not limited to this. For example, the projecting portion 23A may be formed to be a conically projecting portion with a sloping portion whose projecting dimension decreases as being closer to the inner circumferential surface 24A.

In the manufacturing device according to the above-described embodiment, when the workpiece 1 is transferred from the first stage to the second stage and to the third stage sequentially, the first plastic forming through the third plastic forming are performed to the workpiece 1 sequentially.

However, the present disclosure is not limited to this. Specifically, the workpiece 1, for example, may not be transferred. Instead, the respective dies and punches may be changed for performing the first plastic forming through the third plastic forming to the workpiece 1 sequentially.

In the manufacturing device according to the above-described embodiment, the first die 13 of the first stage and the third die 23 of the second stage are different metal molds. However, the present disclosure is not limited to this. For example, the first die 13 of the first stage and the third die 23 of the second stage may be identical metal molds.

Further, the present disclosure is not limited to the above-described embodiments as long as it falls within the scope of the invention described in the claims. Accordingly, at least two of the above-described embodiments may be combined together.

What is claimed is:

1. A manufacturing method of forming a workpiece from a metal plate, the workpiece including a cylindrical portion in a cylindrical shape protruding in a plate thickness direction of a metal plate and a tooth profile, the cylindrical portion and the tooth profile being formed integrally with the metal plate, the manufacturing method comprising:

plastically forming the cylindrical portion integrally with the metal plate; and plastically forming the tooth profile after the plastically forming of the cylindrical portion is completed, wherein the plastically forming of the cylindrical portion uses a manufacturing device including:

a first metal mold provided with an inner circumferential surface that comes in contact with an outer circumferential surface of the cylindrical portion to be formed;

a second metal mold coming in contact with a protruding tip of the cylindrical portion to be formed; and a third metal mold disposed on an opposite side of the second metal mold with the metal plate therebetween, the third metal mold coming into press contact with the workpiece toward a side of the second metal mold, wherein, in the plastically forming of the cylindrical portion, the third metal mold is displaced toward the side of the second metal mold and a portion of the metal plate undergoes plastic flow toward the inner circumferential surface, such that the portion of the metal plate that underwent the plastic flow comes into press contact with the inner circumferential surface, and wherein, in the plastically forming of the tooth profile, the tooth profile is plastically formed on an outer side in a radial direction of the cylindrical portion in the metal plate.

2. The manufacturing method according to claim 1, further comprising:

performing punching after the plastically forming of the cylindrical portion and before the plastically forming of the tooth profile, wherein the punching uses the manufacturing device including:

the first metal mold;

the third metal mold; and a tubular metal mold having an inner diameter substantially identical to the diameter of the third metal mold, wherein, in the punching, the third metal mold is displaced toward the tubular metal mold and penetrates the protruding tip of the cylindrical portion to provide a through-hole in the protruding tip of the cylindrical portion.

3. The manufacturing method according to claim 1, wherein a diameter of the third metal mold is smaller than a diameter of the second metal mold, and the second metal mold includes a cylindrical projecting portion projecting from an end surface of the second metal mold toward the third metal mold, the cylindrical projecting portion being provided at a position that is opposed to the third metal mold, and having a diameter substantially corresponding to the diameter of the third metal mold.

4. A manufacturing method of forming a workpiece from a metal plate, the workpiece including a cylindrical portion in a cylindrical shape protruding in a plate thickness direction of a metal plate and a tooth profile, the cylindrical portion and the tooth profile being formed integrally with the metal plate, the manufacturing method comprising:

plastically forming an intermediate workpiece including a protruding portion integrally formed with the metal plate;

plastically forming the cylindrical portion, after the plastically forming of the intermediate workpiece; and plastically forming the tooth profile, after the plastically forming of the cylindrical portion is completed, wherein, in the plastically forming of the intermediate workpiece, a portion of the metal plate is pressed to undergo plastic flow, so that the protruding portion protrudes from the metal plate in a first direction of the plate thickness direction of the metal plate, wherein the plastically forming of the cylindrical portion uses a manufacturing device including:

a first metal mold provided with an inner circumferential surface that comes in contact with an outer circumferential surface of the cylindrical portion to be formed;

a second metal mold coming in contact with a protruding tip of the cylindrical portion to be formed; and a third metal mold disposed on an opposite side of the second metal mold with the intermediate workpiece therebetween, the third metal mold coming into press contact with the workpiece toward a side of the second metal mold, wherein, in the plastically forming of the cylindrical portion, the third metal mold is displaced in the first direction toward the side of the second metal mold and a portion of the protruding portion undergoes plastic flow toward the inner circumferential surface, such that the portion of the protruding portion that underwent the plastic flow comes into press contact with the inner circumferential surface, and wherein, in the plastically forming of the tooth profile, the tooth profile is plastically formed on an outer side in a radial direction of the cylindrical portion in the metal plate.

5. The manufacturing method according to claim 4, wherein the plastically forming of the intermediate workpiece uses the manufacturing device including:

a first die coming in contact with a protruding tip of the protruding portion to be formed;

a second die provided with an inner circumferential surface that comes in contact with an outer circumferential surface of the protruding portion to be formed;

a movable punch disposed on an opposite side of the first die with the metal plate therebetween, the movable punch coming into press contact with the metal plate in the first direction toward a side of the first die, wherein a diameter of the movable punch being greater than a diameter of the first die, and a diameter of the third metal mold is smaller than a diameter of the second metal mold.

6. The manufacturing method according to claim 5, wherein the movable punch includes a tapered portion at an end of an outer circumferential portion of the movable punch, the tapered portion having a truncated cone shape so as to slope and come closer to the first die as the truncated cone shape approaches the central axis of the movable punch.

* * * * *